US009533861B2

(12) United States Patent
Esteban Fink et al.

(10) Patent No.: US 9,533,861 B2
(45) Date of Patent: Jan. 3, 2017

(54) SELF-BALANCED APPARATUS FOR HOISTING AND POSITIONING LOADS, WITH SIX DEGREES OF FREEDOM

(71) Applicant: AIRBUS DEFENCE AND SPACE, S.A., Getafe (Madrid) (ES)

(72) Inventors: Fernando Enrique Esteban Fink, Getafe (ES); Francisco Josè León Arevalo, Getafe (ES); Enrique Del Pozo Polidoro, Seville (ES); Manuel Pérez López, Seville (ES)

(73) Assignee: Airbus Defence And Space, S.A., Getafe (Madrid) (ES)

( * ) Notice: Subject to any disclaimer, the term of this patent is extended or adjusted under 35 U.S.C. 154(b) by 0 days.

(21) Appl. No.: 15/098,583

(22) Filed: Apr. 14, 2016

(65) Prior Publication Data

US 2016/0304325 A1 Oct. 20, 2016

(30) Foreign Application Priority Data

Apr. 15, 2015 (EP) ..... 15382183

(51) Int. Cl.
*B66C 1/00* (2006.01)
*B66C 1/10* (2006.01)

(52) U.S. Cl.
CPC ..... *B66C 1/10* (2013.01)

(58) Field of Classification Search
CPC ..... B66C 1/10; B66C 13/08; B66C 13/06; B66C 1/105
USPC ..... 294/81.4, 81.3, 67.5, 67.21, 67.4, 74
See application file for complete search history.

(56) References Cited

U.S. PATENT DOCUMENTS 4,883,184 A 11/1989 Albus
4,932,541 A 6/1990 Belsterling
5,617,964 A * 4/1997 Lucking ..... B25J 17/0216 212/319
2009/0035739 A1* 2/2009 Alemzadeh ..... A61C 11/00 434/264
2009/0066100 A1* 3/2009 Bosscher ..... B25J 17/0266 294/86.4

(Continued)

FOREIGN PATENT DOCUMENTS

DE 2404147 A1 * 7/1975 ..... B66C 1/10

OTHER PUBLICATIONS

Extended European Search Report; Dated Sep. 22, 2015; 4 Pages.

*Primary Examiner* — Gabriela Puig
(74) *Attorney, Agent, or Firm* — Dickinson Wright PLLC

(57) ABSTRACT

An apparatus for hoisting and positioning a load in a self-balanced manner regardless of the position of its center of gravity. The apparatus comprises an upper platform adapted for being hoisted from a general hoisting point, a lower platform adapted the attachment of a load to be hoisted and positioned, and a six degrees of freedom actuator comprising six variable length tendons, adapted for moving the lower frame with respect the upper frame in the three directions of the space and tilted around the three axis of the space. A configurable counterweight system supported by the upper platform is arranged for modifying the center of mass of the apparatus over a horizontal plane, and processing means are configured for dynamically calculating a desired position of the counterweight system, for balancing the apparatus with the respect to a general hoisting point.

12 Claims, 9 Drawing Sheets

(56) References Cited

U.S. PATENT DOCUMENTS

| | | | | |
|---|---|---|---|---|
| 2012/0180593 | A1* | 7/2012 | Alet | B25J 9/0042 74/490.07 |
| 2014/0217050 | A1 | 8/2014 | Sturm, Jr. | |
| 2015/0314994 | A1* | 11/2015 | Meyer | B66C 1/108 414/589 |

* cited by examiner

SELF-BALANCED APPARATUS FOR HOISTING AND POSITIONING LOADS, WITH SIX DEGREES OF FREEDOM

CROSS-REFERENCE TO RELATED APPLICATIONS

The present disclosure claims priority to European Application No. 15382183.0 filed on Apr. 15, 2015, which is hereby incorporated by reference, as though set forth fully herein.

FIELD OF DISCLOSURE

The present disclosure refers in general to apparatus for stabilizing and handling a hoisted load.

An object of the present disclosure is to provide an apparatus for hoisting and positioning, in an auto-balanced manner, a load regardless of the position of its center of gravity, such as a wide range of parts varying in size and shape that can be aerially transported and handled easily and securely.

BACKGROUND OF THE DISCLOSURE

The potential motion of a hoisted object can best be envisioned by a Cartesian coordinate system in which the z-axis is in the vertical direction, and the x and y axes form the horizontal plane. The rotation of the hoisted object about the z-axis is therefore defined as yaw, rotation about the x-axis is defined as pitch, and rotation about the y-axis is defined as roll.

In typical load transporting applications, a crane will have a single lifting cable, which is stable only in the z-direction. If an external force is applied from the sides, the load will either roll, pitch, or yaw, or will sway in the x- and y-directions.

While the loads are being hoisted, it is essential that the center of mass of the assembly formed by the hoisting apparatus and the load, is vertically aligned with the hoisting point in order to have the assembly balanced. Otherwise, the assembly may rock and swing, causing damages to the part itself, to the surrounding equipment or even causing injuries to human operators.

Therefore, the prior art has long recognized the need to compensate for these undesired motions, and as a result various solutions have been developed for stabilizing a hoisted load. For example, U.S. Pat. No. 4,883,184 describes a cable arrangement and lifting platform in a stabilized manner. The lifting platform secures loads to a securing device and the platform is able to be suspended from a crane by an attachment carriage. The attachment carriage includes a cable winch onto which six cables suspend and attach to the lifting platform. The attachment carriage also includes cable guides which guide the six cables away from the winch in three cable pairs, preferably equidistantly-spaced.

In order to secure the cables to the lifting platform, the platform includes an attachment frame having three cable attachment points, preferably spaced equidistantly apart with respect to each other. The lifting platform helps stabilize the lifting of loads by sensing the load's imbalance relative to the center of mass of the platform and repositioning the load to correct for the imbalance.

The U.S. Pat. No. 4,932,541 describes a stabilized cargo-handling system using means for stabilizing a suspended cargo in all six degrees of freedom using six individually controlled cables in tension in a kinematic arrangement.

Inertial and distance sensors, coupled with cable drives, control the multi-cabled crane automatically.

On the other hand, six degrees of freedom actuation devices, generally known as hexapods, are commonly used for example in flight or driving simulators, which are capable of moving a platform on which a simulation cabin is mounted, with six degrees of freedom in space. The best known prior art mobile platform, is a Stewart platform, which is based on the use of a hexapod positioning device allowing motion with six degrees of freedom. The type of motion of these platforms forms part of the family of parallel robots.

The U.S. Patent Publication Nos. 2009/0035739A1 and 2012/0180593A1 describe and illustrate in more detail examples of Stewart platforms Typically, a Stewart platform comprises a fixed lower plate, six telescopic actuators and a mobile upper plate, wherein the telescopic actuators are pivotally connected at their opposite ends to the base plate and to the mobile upper plate, there being three attachment points on each of the base plate and mobile upper plate to which respective pairs of the telescopic actuators are connected. As a consequence of this known arrangement, the mobile upper plate has six degrees of freedom, that is, both rotation and translation about the X-, Y- and Z-axes.

Cable-suspended robots or tendon-driven robots, generally referred as cable robots, are also known, and are based on multiple cables attached to a mobile platform that may carry one or more manipulators or robots. The platform is manipulated by motors that can extend or retract the cables. Cable robots are used for various manipulation tasks in a three-dimensional workspace, as for example material handling, haptics, etc. The U.S. Patent Publication No. 2009/0066100A1 refers to a cable robot of this type.

In the aeronautical industry, large and heavy parts like horizontal tail planes, wings or fuselage sections, have to be hoisted and transported from one working station to another within a factory or assembly plant. For this task, hosting mechanisms, such as overhead cranes or winches are commonly used to provide the necessary lifting force to lift the part.

Hosting and positioning these large aircraft parts is a challenge because a large variety of parts of different sizes and weights, of previously unknown position of the center of gravity, have to be transported and handled within a factory. A classical solution, is to provide a dedicated lifting equipment for each part, but this solution is very expensive and cumbersome, since a large number of hosting equipment (jigs) are required.

Consequently, although many self-balanced load hoisting systems are already known, none of them has been specifically conceived for solving the problems of hoisting and handling large aircraft parts in the aeronautical industry

SUMMARY OF THE DISCLOSURE

The present disclosure solves the above-mentioned drawbacks of the prior art, by providing an apparatus for hoisting and positioning a load in a self-balanced manner, without knowing in advance the position of the center of gravity of the load to be lifted.

The apparatus comprises two superimposed platforms, an upper platform which is meant to be hoisted by an external and conventional lifting equipment, such as in use the apparatus is hoisted from at least one hoisting point, and a lower platform which is meant to be attached to a piece or part to be transported and positioned, such as in use, this part is attached to the lower platform.

Additionally, the apparatus comprises a six degrees of freedom actuator, which includes six variable length tendons wherein each tendon is coupled with the upper platform and with the lower platform, in such a manner that the lower platform is suspended from the upper platform by means of these six variable length tendons. For these connections, three attachment points are respectively defined on the upper and the lower platforms, so that a pair of tendons are connected to each attachment point.

The three attachment points at the upper platform are laying within the same plane, and in a preferred aspect of the apparatus are equidistantly spaced from each other, so that, these attachment points are the three vertexes of a equilateral triangular configuration. Similarly, the three attachment points at the lower platform are laying within the same plane, and in a preferred aspect of the apparatus are equidistantly spaced from each other, so that, these attachment points are the three vertexes of a equilateral triangular configuration and at the lower platform. However, in other preferred aspects of the apparatus, other types of triangular configurations are considered for the upper and lower platforms.

Preferably, the upper and/or the lower platforms have/has a triangular frame, preferably equilateral, such as each triangular frame or platform, define those vertexes, which are equidistantly-spaced in the case of an equilateral configuration. When both the upper and the lower platforms include respective equilateral triangular frames, the relative position of these two superimposed frames is offset, that is, the vertexes of each triangular frames, are not vertically aligned.

With this arrangement, the load of a part to be hoisted, is supported by said tendons, thus, when the apparatus is in use, the tendons are tensioned mainly by the load being hoisted, and by the load of the lower platform. Being the number of tendons equal to the degrees of freedom, the application of a vertical load implies that all tendons shall be submitted to tensile loads. Should the position of the center of gravity do not satisfy determined geometrical criteria, one or several tendons would be submitted to compressions loads. Being the tendon able to support tensile loads only, such a condition would eventually cause the collapse of the device.

Each variable length tendon is an elongated and flexible element, for example an adjustable cable or an adjustable strap, adapted to be linearly extended and retracted, for example by means of a winch mechanism or a similar device.

Preferably, each variable length tendons has one end articulately connected to a connection point or vertex of the lower platform, and another end connected to a winch located in the upper platform. Said articulated connections may be implemented with eyes, shackles or any other type of cable fitting or hardware.

By operating the six degrees of freedom actuator in a known manner, that is, by varying individually and in a coordinated manner the length of the variable length tendons, the lower platform (and in turn the piece attached to it) can be moved relative to the upper platform, in the three directions of the space and tilted around the three axis of the space (x, y, z) (either with respect to the center of the upper platform or the center of the lower platform), resulting in a total of six degrees of freedom.

The apparatus further comprises a configurable counterweight system supported by the upper platform, and adapted for leveling the upper platform to keep it horizontal. The configurable property of the counterweight system, means that its mass distribution is variable, more specifically it is variable within a plane in order to keep the upper platform horizontal compensating any eccentricity caused in the apparatus at the moment of hoisting a part without considering its center of gravity, or at the moment of modifying the position of a hoisted part. Said mass distribution can be modified for example by displacing any of the weights that build up the system within a horizontal plane.

By properly arranging the mass distribution of counterweight system, the location of the center of gravity of the assembly formed by the apparatus and the lifted part, is varied in order to get vertically aligned with the general suspension point. Therefore, the configurable counterweight system allows stabilized movements of a hoisted piece, avoiding undesired rolling and pitching movements.

The apparatus additionally comprises load measuring means adapted for individually measuring tensile forces transmitted by each of the six variable length tendons. Such load measuring, combined with the geometry of the assembly, allows the control system to calculate exactly the weight of the part being lifted and the position of its center of gravity.

The apparatus is also provided with processing means configured for dynamically calculating a desired configuration of the counterweight system, based on measuring the tensile load of the tendons (an inclinometer is used only as a security system to ensure the correct operation) when the load is gently lifted before totally leaving the ground.

As an additional safety feature, the angle of the upper frame related to the horizontal plane is measured by an inclinometer, so an abnormal situation may be promptly detected and the maneuver aborted.

By automatically calculating the location of the center of gravity of the whole assembly (apparatus and part), a corrective mass distribution of the counterweight system can be set dynamically, keeping the assembly leveled, thus avoiding unwanted oscillations and reducing drastically the number of lifting equipment needed in a manufacturing or assembly plant.

Once the leveling of the assembly in a given position of the load has been fully achieved, any further movement of the load in x-, y- and z-axis would be automatically accompanied by the coherent adjustment of the counterweight system, in such a way that the assembly is always dynamically kept horizontal in real time.

Since the apparatus is auto-balanced several operations can be performed, such as swing-free horizontal transport, as well as zero-gravity manipulation of heavy items with a minimal effort of the staff, so the manpower required can be considered reduced when related to purely manual operation.

BRIEF DESCRIPTION OF THE FIGURES

Preferred aspects of the present disclosure are henceforth described with reference to the accompanying Figures, wherein.

DETAILED DESCRIPTION OF THE PRESENT DISCLOSURE

Figure 1A:
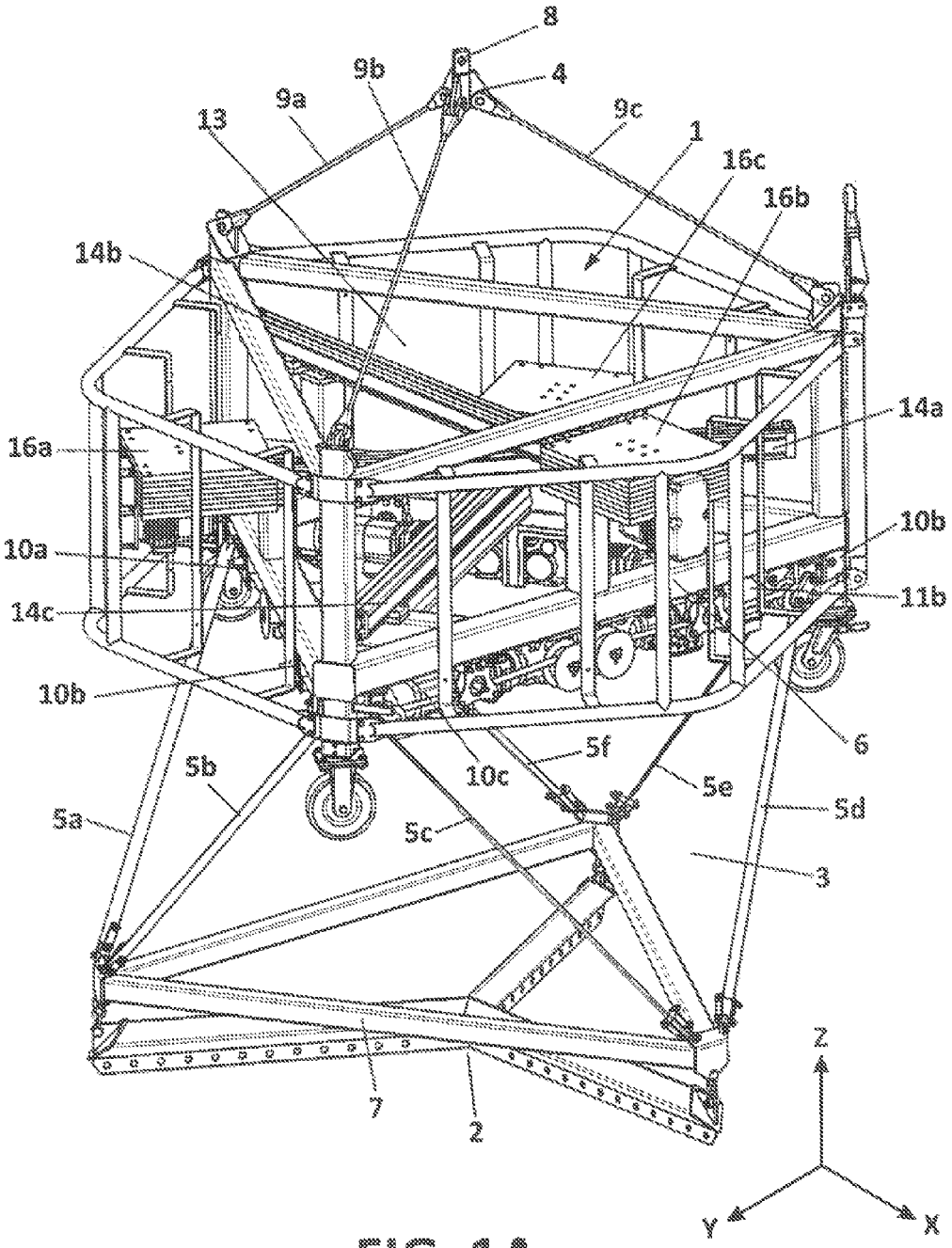
FIG. 1A shows a perspective view of an example of an apparatus for hoisting and positioning a load in a self-balanced manner with six degrees of freedom in accordance with an aspect of the present disclosure.
Figure 1B:
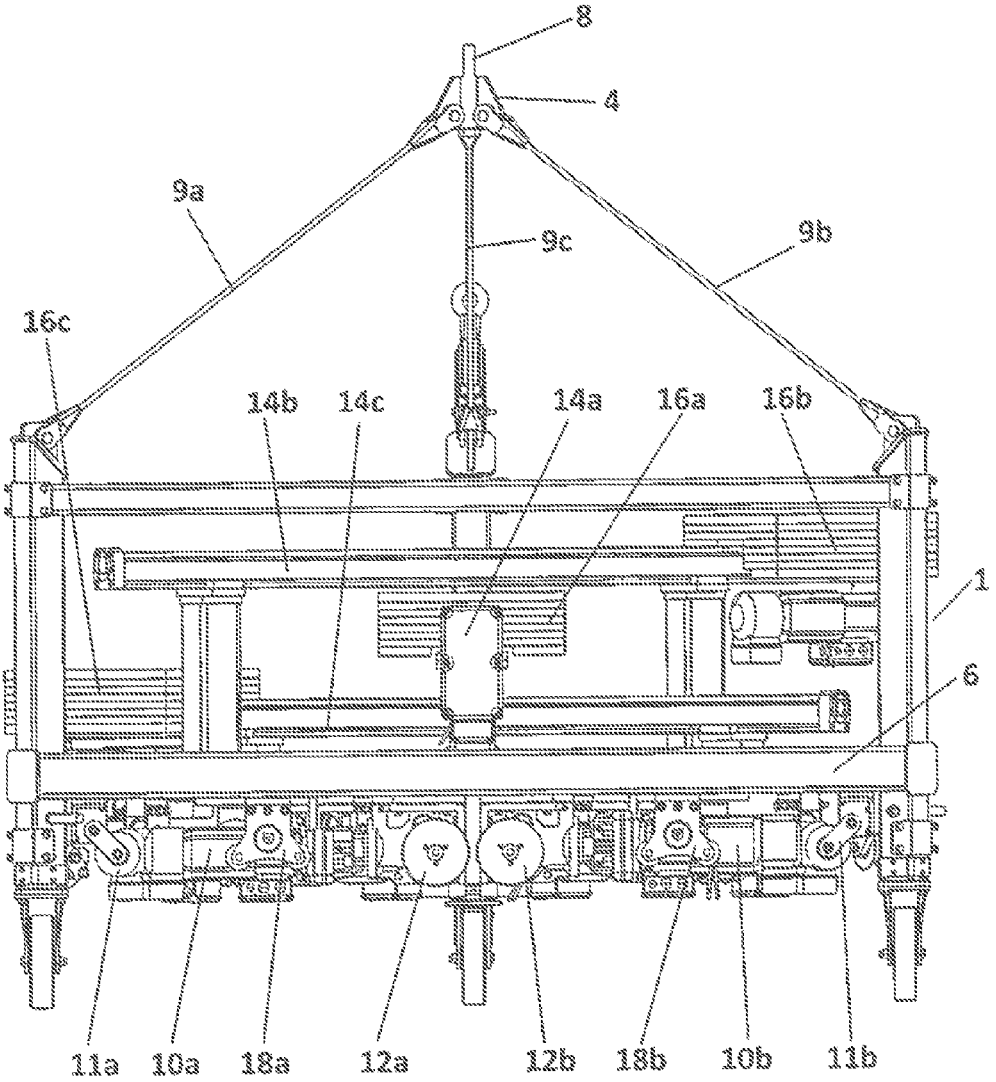
FIG. 1B shows an elevational front view of an example of an upper platform of an apparatus for hoisting and positioning a load in a self-balanced manner with six degrees of freedom in accordance with an aspect of the present disclosure.
Figure 2A:
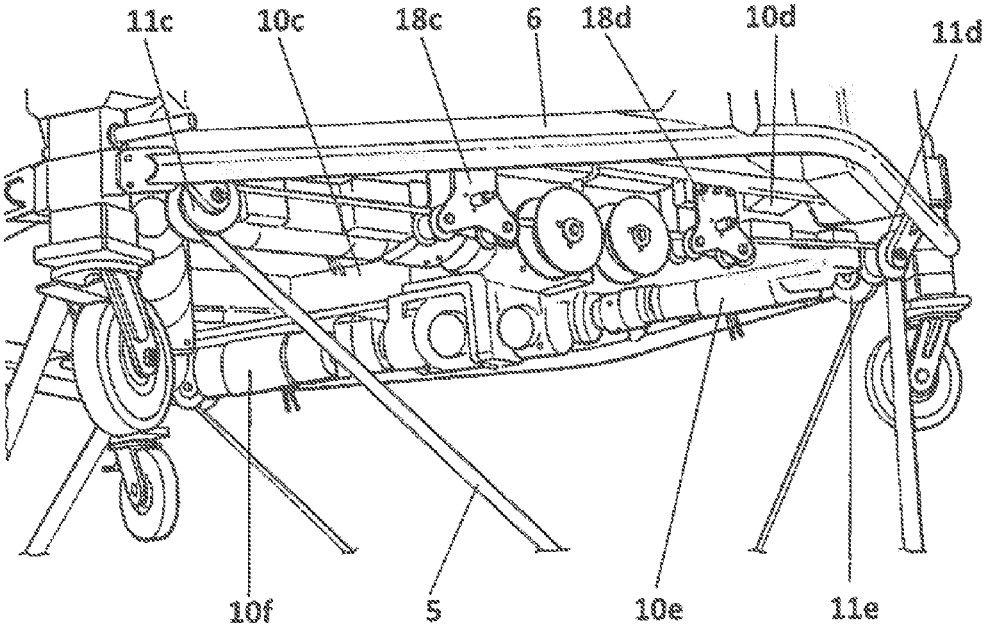
FIG. 2A shows a perspective view of another example of the upper platform of an apparatus for hoisting and positioning a load in a self-balanced manner with six degrees of freedom in accordance with an aspect of the present disclosure.
Figure 2B:
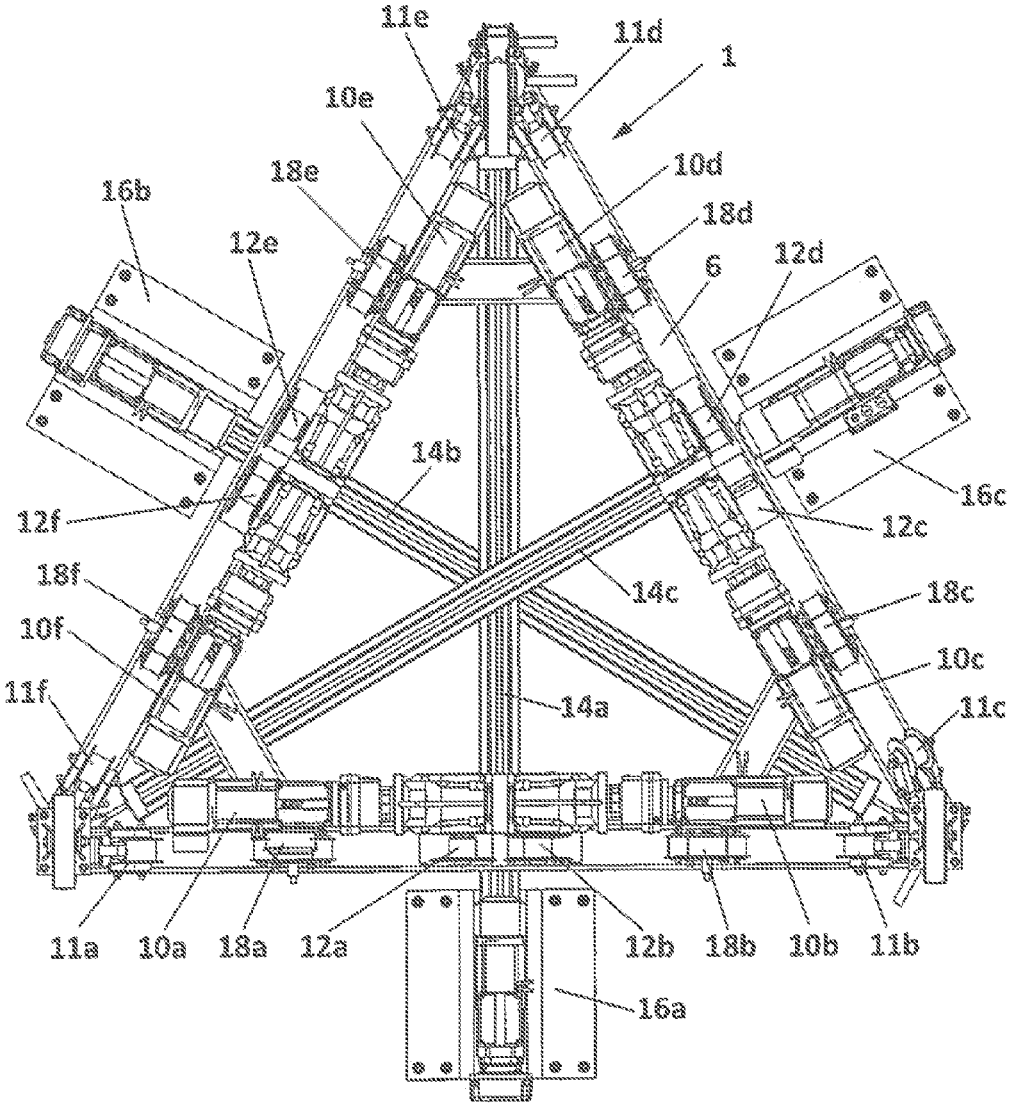
FIG. 2B shows a bottom plan view of an example of an upper platform of an apparatus for hoisting and positioning a load in a self-balanced manner with six degrees of freedom in accordance with an aspect of the present disclosure.

FIGS. 1A and 1B show an exemplary aspect of the apparatus of the present disclosure, which comprises an upper platform (1) and a lower platform (2) arranged below the upper platform, and a six degrees of freedom actuator (3) connected with the upper and lower platforms (1,2), as to configure an inverted Stewart platform for moving the lower platform (2) relative to the upper platform (1), such as a part (not shown) attached to the lower platform (2) can be moved with six degrees of freedom at the same time that it is being hoisted. The apparatus is intended to provide a way of easily achieving accurate movements of the load, while coarse displacements can be obtained via an overhead crane or any other industrial apparatus for material handling.

The upper platform (1) includes an upper equilateral triangular frame (6) adapted for being hoisted from a general hoisting point; for that purpose, the apparatus includes a connection member (4) having a ring or eye (8) (which defines said general hoisting point), for receiving the hook of a crane (not shown), and three rods (9*a*, 9*b*, 9*c*) with same length and having opposite ends connected respectively with the connection member (4) and with the upper platform (1). The points at the upper frame where the three rods (9*a*, 9*b*, 9*c*) are connected, are spaced in such a way so that the ring or eye (8) is vertically aligned with the geometric center of the upper triangular frame (6).

On the other hand, the lower platform (2) includes a lower equilateral triangular frame (7) adapted for the attachment of a part to be lifted and positioned.

The six degrees of freedom actuator (3) comprises six variable length tendons (5*a*, 5*b*, 5*c*, 5*d*, 5*e*, 5*f*), which in this aspect consist of a cable or strap of suitable material. Each of the three vertexes of the upper and lower triangular frames (6,7), is provided with articulated connection means, such as each tendon (5*a*, 5*b*, 5*c*, 5*d*, 5*e*, 5*f*), is connected between one the three vertexes of lower triangular frame (7) and one of the three vertexes of upper triangular frame (6), such as, the lower triangular frame (7) is suspended from the upper triangular frame (6), and the tendons are tensioned by the weight of the lower frame and any load attached to it.

Figure 4A:
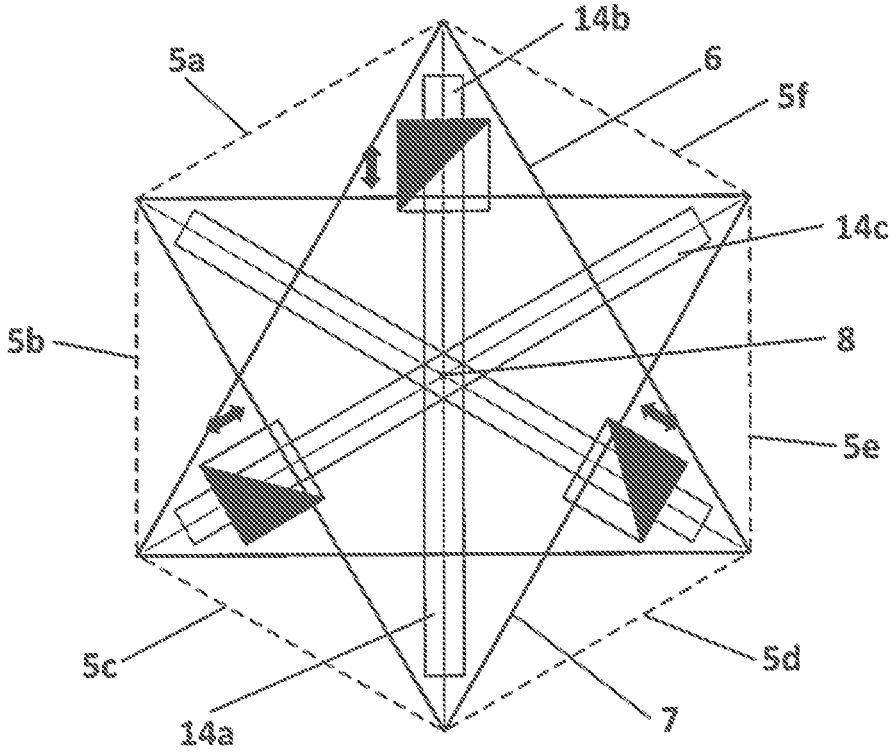
FIGS. 4A and 4B show schematic representations in plant view of an apparatus for hoisting and positioning a load in a self-balanced manner with six degrees of freedom in accordance with an aspect of the present disclosure, which serves to illustrate the operation of the counterweight system of the present disclosure. The position of each variable length tendon is represented with broken lines in FIG. 4A.

Preferably, upper and lower triangular frames (6,7) have the same size, and are offset to each other as shown more clearly in FIG. 4A. In this way, the working space, that is the space wherein the center of gravity of the assembly formed by the lower platform and a piece attached to it, can be moved without compressing the six variable length tendons, is axis-symmetric. As shown more clearly in FIG. 4A, in a plan view, the working space is a regular hexagon obtained by the intersection of the two upper and lower triangular frames.

Figure 5:
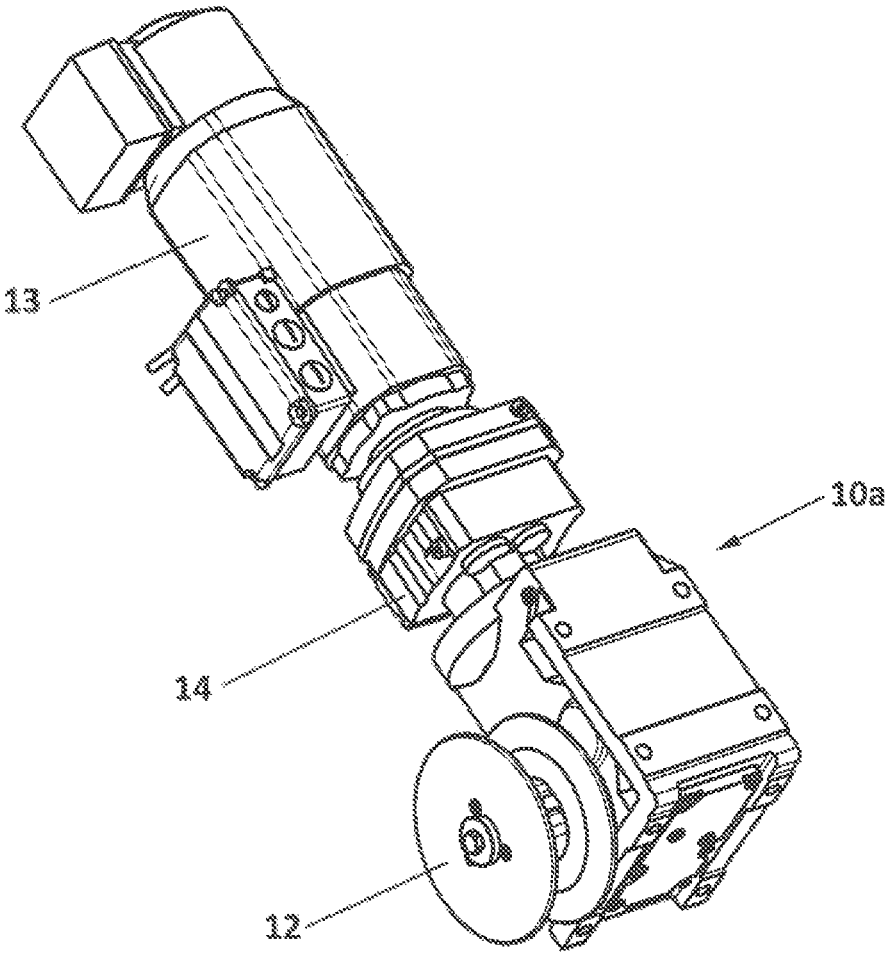
FIG. 5 shows a perspective view of one of a motor-driven winding spool for varying the length of the tendons of an apparatus for hoisting and positioning a load in a self-balanced manner with six degrees of freedom in accordance with an aspect of the present disclosure.

For varying the length of each tendon, a winch mechanism (10*a*, 10*b*, 10*c*, 10*d*, 10*e*, 10*f*) such as the motor-driven winding drum shown in FIG. 5, is individually provided for each one of the six tendons (5*a*, 5*b*, 5*c*, 5*d*, 5*e*, 5*f*), and as shown in FIG. 1A, each variable length tendon has one end articulately connected with one vertex of the lower triangular platform (7), and another end connected with its associated winch mechanism, such as the length of each variable length tendon is varied by alternatively winding and unwinding each tendons on its associated winch mechanism.

Each winch mechanism (10*a*, 10*b*, 10*c*, 10*d*, 10*e*, 10*f*), conventionally comprises a pulley (12*a*, 12*b*, 12*c*, 12*d*, 12*e*, 12*f*) driven by an electric motor (17) through a reduction gearbox. The winch mechanism includes a brake, built-in encoder, and it is controlled by a closed-loop electronic frequency inverter.

In the aspect of FIG. 1A, the winch mechanisms (10*a*, 10*b*, 10*c*, 10*d*, 10*e*, 10*f*) are coupled with the upper triangular frame (6). In this aspect, each of the three sides of the upper triangular frame (6) has two winch mechanisms, and the pulleys of the same are placed approximately in the middle of that side. Each vertex of the upper triangular frame (6) has two free-spinning pulleys (11*a*, 11*b*, 11*c*, 11*d*, 11*e*, 11*f*), one for each of the two tendons connected to each vertex. An intermediate part of each tendon roll on its associated pulley as the tendon is being extended and retracted by the respective winch.

By controlling the operation of each winch mechanism (10*a*, 10*b*, 10*c*, 10*d*, 10*e*, 10*f*), the length of each tendon is individually varied, such as the lower triangle frame (7) can be moved with six degrees of freedom in all directions and angles of the space.

Figure 3:
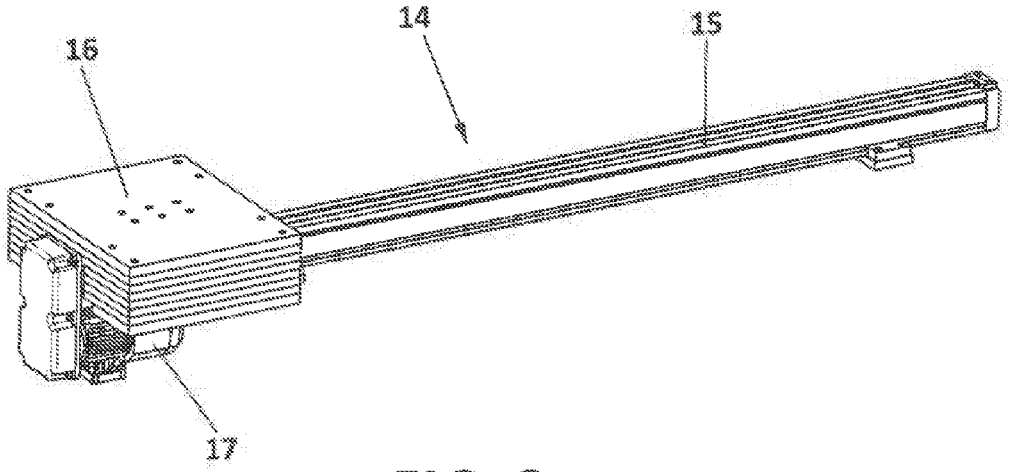
FIG. 3 shows a perspective view of an example of a counterweight device of a counterweight system of an apparatus for hoisting and positioning a load in a self-balanced manner with six degrees of freedom in accordance with an aspect of the present disclosure.

A configurable counterweight system (13) is fitted to the upper triangular frame, and comprises at least one counterweight device (14) as the one shown in more detail in FIG. 3, which includes a lineal guide (15) and a weight (16) mounted on the lineal guide (15) and an electric motor (17), for moving the counterweight system to the desired positions calculated by the processing means, for linearly displacing the weight (16) along the guide (15), for example a ball screw drive, a chain, a belt or any other conventional technique. The counterweight device (14) is arranged such as its weight (16) is displaceable on a third plane parallel to the first plane. Control means for operating the counterweight system, may comprise a speed controller for the electric motors, encoders and electronic control means.

Although any counterweight system able to displace a mass over a horizontal plane would be useful for the purpose of the apparatus, only the triple radial system hereby described allows obtaining the desired mass displacement in a progressive way, with minimum load jerks, and in a minimum time.

Preferably, the counterweight system (13) comprises three counterweight devices (14*a*,14*b*,14*c*) placed one above the other, such as the weights (16*a*, 16*b*, 16*c*) of the counterweight devices are displaceable on overlapping planes, parallel to each other and parallel to the plane defined by the upper triangular frame (6). Additionally the relative arrangement of the three counterweight devices (14*a*, 14*b*, 14*c*) is shown in FIG. 4A, wherein it can be seen that each lineal guide (15*a*, 15*b*, 15*c*) of the counterweight devices (14*a*, 14*b*, 14*c*), is aligned with one bisecting line (bisector) of the upper or lower triangular frames (6,7), and pass through the central point of each counterweight devices (14*a*, 14*b*, 14*c*) is vertically aligned with the geometric center of the upper triangular frame (6).

Load measuring means are provided for measuring axial forces transmitted by each of the six variable length tendons, which represent the degrees of freedom of the actuator device, in particular a load sensor (18*a*, 18*b*, 18*c*, 18*d*, 18*e*, 18*f*) is provided for each tendon (5*a*, 5*b*, 5*c*, 5*d*, 5*e*, 5*f*).

Figure 6B:
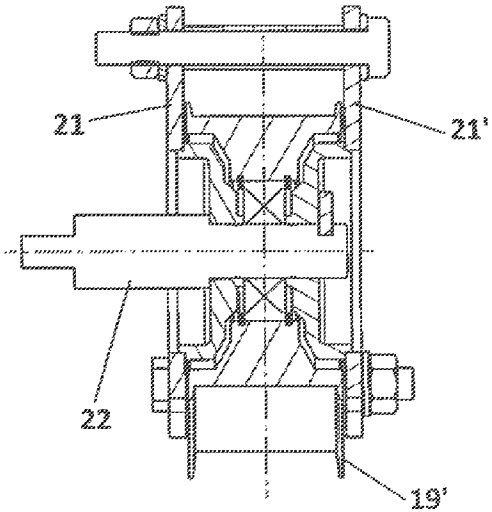
FIG. 6B shows a cross-sectional view taken along line A-A of a proposed means for measuring the axial tension in each tendon of an apparatus for hoisting and positioning a load in a self-balanced manner with six degrees of freedom in accordance with an aspect of the present disclosure.
Figure 6A:
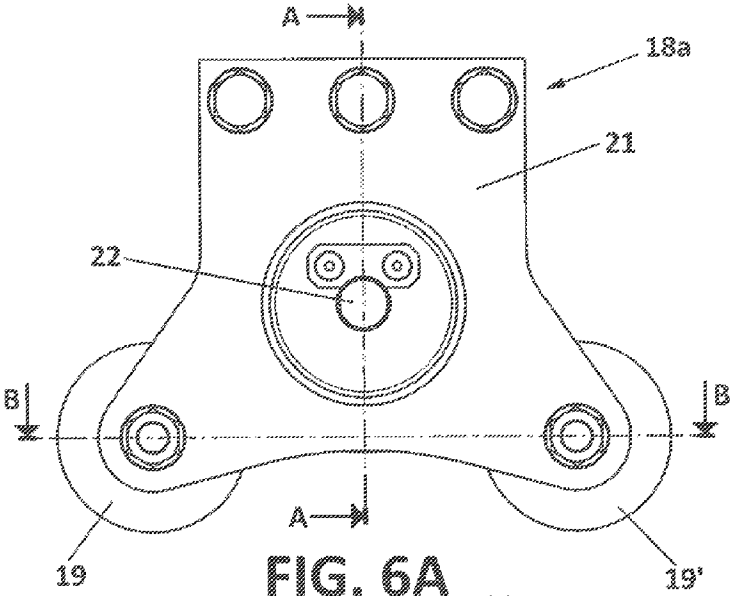
FIG. 6A shows a front elevational view of a proposed means for measuring the axial tension in each tendon of an apparatus for hoisting and positioning a load in a self-balanced manner with six degrees of freedom in accordance with an aspect of the present disclosure.
Figure 6C:
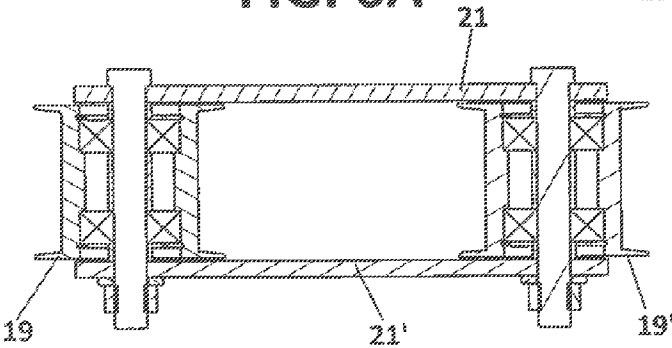
FIG. 6C shows a cross-sectional view taken along line B-B of a proposed means for measuring the axial tension in each tendon of an apparatus for hoisting and positioning a load in a self-balanced manner with six degrees of freedom in accordance with an aspect of the present disclosure.

The configuration of these load sensors (18) is represent in FIG. 6A, which is based on a set of three pulleys, two side pulleys (19,19') and a central pulley (20) assembled between front and rear walls (21,21'), such as the respective tendon (5) under tension run through these three pulleys, and it is pressed against the central pulley (20) in its radial direction, so as to exert a resulting force proportional to the tension in the tendon (5).

For measuring that force, the central pulley (20) has a load pin or load bolt (22) axially arranged therein. A load pin is known device conventionally used to measure radial forces applied to the axis of the load pin, formed by a rod-shaped metallic member having strain gauges for measuring deformation of that member.

Figure 6D:
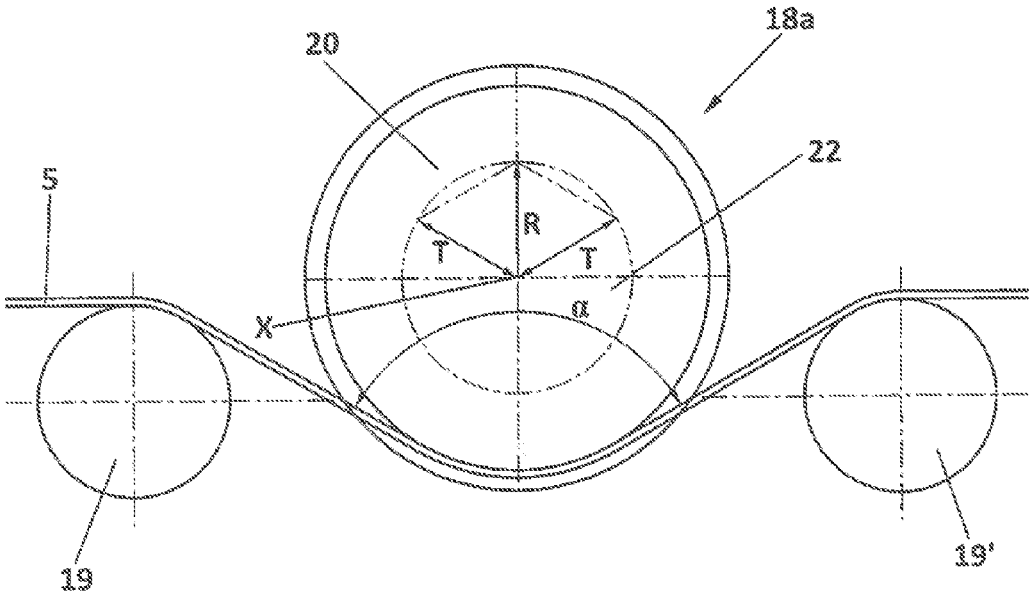
FIG. 6D shows a schematic representation of an example of an operating principle of a measuring device of a proposed means for measuring the axial tension in each tendon of an apparatus for hoisting and positioning a load in a self-balanced manner with six degrees of freedom in accordance with an aspect of the present disclosure.

FIG. 6D shows the operating principle of this assembly, and the composition of forces in the axle (x) of the central pulley (20), where the angle (a) formed by the strands of the tendon (5) on the central pulley (20) is 120°, showing that the resulting force (R) is equal to the tension of the tendon (5). If the angle ($\alpha$) is not 120° the resulting force (R) is different to the tension of the tendon (T), but the forces relationship, could be easily calculated.

The apparatus also includes processing means (not shown) such as an industrial computer, configured for dynamically calculating a desired position of the configurable counterweight system, based on weight and center of gravity measures provided by the load measuring means, and angle measures of the upper frame related to the horizontal plane.

The self-balancing function of the apparatus is carried out by a control system including several encoders, level and load sensors, an industrial computer to solve the problem kinematic and dynamic of the Stewart platform and for implementing a control algorithm specifically developed for the apparatus, and a control post allowing a human operator to receive signals from and to send orders to the control system.

The apparatus is capable of keeping itself balanced all time regardless of the position of the center of gravity of a load being hoisted by automatically setting a configuration, that is, a position of the weights of the counterweight system, such as the location of the center of gravity of the whole assembly is made coincident with the general hoisting point. At the same time, a part attached to the lower triangular frame (7), while it is being hoisted can be moved to any desired position by actuating the inverted Steward platform, obviously within the geometrical and physical limitations of the apparatus, and the mass compensation capacity of the counterweight system.

As a part of the control system, a mathematical logical algorithm has been developed to determine the optimal position of the masses belonging to the counterweight system, for a given location of the center of mass and minimizing the distances to the center of the triangle.

Figure 4B:
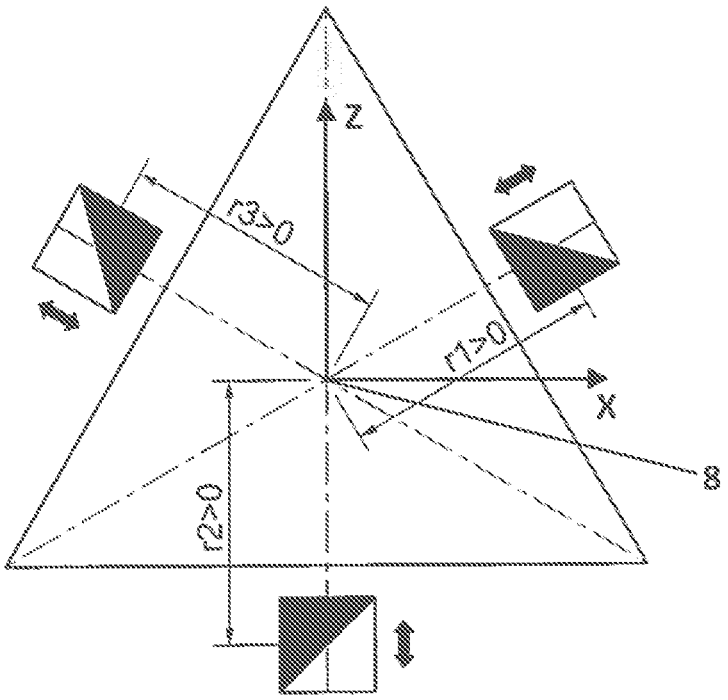

Taking into account a star or radial configuration for the counterweight system, as shown in FIGS. 4A and 4B the algorithm has the purpose of determining the position of the three weights (16*a*, 16*b*, 16*c*). This problem is mathematically indeterminate given that three variables must be defined for positioning the three weights, but only two equilibrium equations (X-axis and Y-axis) are available. The solution is attained by adding to the two equations a third condition, by imposing the counterweight displacement to be kept to a minimum.

The mathematical procedures normally used to solve such systems of equations containing several inequalities are based on linear programming techniques or general numerical methods. In this particular case, given that only three unknown variables and one objective function are present, it is possible to solve for two variables by using the equilibrium equation, and then replacing their values in the objective function.

By deriving the objective function respect to third variable and making it equal to zero, a relative maximum or minimum may be detected within the interval considered.

In order to minimize the displacements of the counterweight system, several objective functions may be implemented. The best results have been achieved by adding the squares of the displacement of all masses, as taken from the geometrical center of the upper frame.

Other preferred aspects of the present disclosure are described in the appended dependent claims.

What is claimed:

1. An apparatus for hoisting and positioning a load in a self-balanced manner with six degrees of freedom, comprising:

an upper platform adapted to hang from a general hoisting point;

a lower platform arranged below the upper platform and adapted to hold the load to be hoisted and positioned;

a six degrees of freedom actuator having six variable length tendons connected with the upper platform and with the lower platform, such that the lower platform is suspended from the upper platform through the six variable length tendons;

wherein the six degrees of freedom actuator is adapted for moving a lower frame with respect to a upper frame in three directions of space and tilted around the three axis of the space;

at least one configurable counterweight system supported by the upper platform, arranged for modifying a center of mass of the apparatus over a horizontal plane allowing a minimum of two degrees of freedom;

a load measuring means adapted for individually measuring forces transmitted by each one of the six variable length tendons;

a processing means configured for dynamically calculating a desired position of the counterweight system, based on weight and center of gravity measures provided by the load measuring means, for balancing the apparatus with the respect the central hoisting point, and a counterweight system control means for moving the counterweight system to the desired positions calculated by the processing means.

2. The apparatus of claim 1, wherein the upper platform has three vertexes spaced within a first plane, and wherein the lower platform has three vertexes spaced within a second plane, and wherein each of the variable length tendons is coupled in an articulated manner with one vertex of the lower platform and with one vertex of the upper platform.

3. The apparatus of claim 1, wherein the lower frame is suspended from the upper frame by means of the variable length tendons, such that the variable length tendons are tensioned by the weight of the lower platform and any load attached to the lower platform.

4. The apparatus of claim 3 further comprising:

a winch mechanism for each variable length tendon for varying the length of the same, and wherein each variable length tendon has one end articulately connected with one vertex of the lower platform, and another end is connected to the associated winch mechanism such that the length of each variable length tendon is varied by alternatively rolling and unrolling each tendon on the associated mechanism.

5. The apparatus of claim 4, wherein the winch mechanisms are coupled with the upper triangular frame, and each vertex of the upper triangular frame has two free-spinning pulleys, and an intermediate part of each tendon is placed to roll on the tendons associated pulley as the tendon is being extended and retracted by the respective winch mechanism.

6. The apparatus of claim 3, wherein each variable length tendon is one of a cable, a link chain, and a strap-like element.

7. The apparatus of claim 1, wherein the load measuring means are adapted for individual measuring axial tension in each variable length tendon.

8. The apparatus of claim 1, wherein the counterweight system includes at least one mobile counterweight displaced within at least one plane.

9. The apparatus of claim 8, wherein counterweight system includes three counterweight devices placed above one another, such that the weights of the counterweight devices are displaceable on parallel and overlapping planes.

10. The apparatus of claim 9, wherein the counterweight devices are arranged such that each weight is displaceable along a straight line passing through any axis of the upper platform.

11. The apparatus of claim 1, wherein at least one of the upper platform and the lower platform have a triangular frame and are arranged such that the relative position of the triangular frame is offset with respect to each other.

12. The apparatus of claim 1, wherein at least one of the upper platform and the lower platform have an equilateral triangular frame.

* * * * *